United States Patent [19]

Bononi

[11] Patent Number: 4,787,278

[45] Date of Patent: Nov. 29, 1988

[54] TOOL BIT DRIVER WITH SPRING RETAINER

[75] Inventor: Fred A. Bononi, Simsbury, Conn.

[73] Assignee: Western Pacific Industries Inc., New York, N.Y.

[21] Appl. No.: 175,206

[22] Filed: Mar. 30, 1988

[51] Int. Cl.[4] ..... B25B 23/00

[52] U.S. Cl. ..... 81/438; 81/125; 81/452; 279/79; 279/102

[58] Field of Search ..... 81/125, 438, 439, 177.85, 81/452; 279/23 R, 24 R, 46 R, 79, 102

[56] References Cited

U.S. PATENT DOCUMENTS

| | | | |
|---|---|---|---|
| 2,304,271 | 12/1942 | Merriman et al. | 87/125 |
| 2,368,902 | 2/1945 | Thompson | 81/125 |
| 2,475,608 | 7/1949 | Gasparich | 279/102 |
| 2,800,822 | 7/1957 | Allred | 81/125 |
| 4,535,658 | 9/1985 | Molinari | 81/438 X |
| 4,644,831 | 2/1987 | Yang | 81/125 |

OTHER PUBLICATIONS

Bit Driver "A" (FIGS. 1-3).
Bit Driver "B" (FIG. 4).
Bit Driver "C" (FIG. 5).

*Primary Examiner*—James G. Smith
*Attorney, Agent, or Firm*—Hayes & Reinsmith

[57] ABSTRACT

In a tool bit driver, a body suitable for mounting on a square drive of a socket wrench is provided with a bit socket adapted for receiving a tool bit at one end of the body, and diametrically opposed grooves are formed to extend longitudinally within the socket. A spring is provided with resilient fingers seated within the socket grooves, and reversely bent ends are formed on each spring finger for engaging the bit in surface-to-surface contact for positively and releasably securing the bit in a driving position within the socket.

11 Claims, 3 Drawing Sheets

FIG. 4
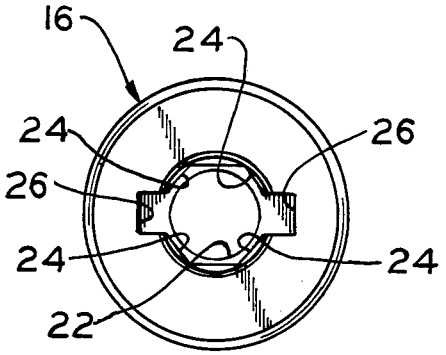
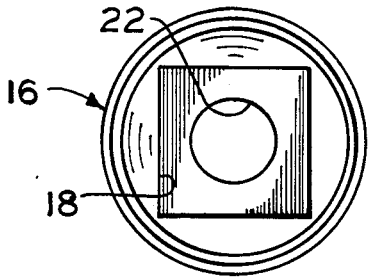
FIG. 5

TOOL BIT DRIVER WITH SPRING RETAINER

FIELD OF THE INVENTION

This invention generally relates to hand tools and particularly concerns a bit driver for receiving and releasably locking a tool bit in an operating position to drive a fastener into a workpiece.

BACKGROUND OF THE INVENTION

Socket wrenches and the like are typically used to drive a variety of tool bits. A driving member of such a device is normally square, and any bit holder or driver to be mounted on the driving member usually has a square drive opening at one end for receiving the driving member of the socket wrench. A socket of hexagonal cross-section is conventionally formed at the other end of the bit driver for receiving a tool bit shank of corresponding cross-section.

One of the problems that arise in use of such drivers is retention of the bit within the socket. Some retaining means within the driver is required for positively securing the bit to prevent its unintended displacement.

Yet another problem lies in the difficulty typically encountered in replacing bits in conventional drivers. Replacement of bits requiring several steps and often a secondary operation in which the retaining means itself must be replaced is time-consuming and, in a production setting, reduces the cost-efficiency of operations.

Conventional drivers typically require the use of tools to insert or remove the bits. Such tools may include a key to adjust a set screw mounted in the driver for securing the bit. Other variations include "C-spring" recessed into the driving faces of the driver. A hammer or punch then is required to remove or insert a bit into such a driver which uses a "C-spring". A new "C-spring" must be inserted each time a bit is replaced because removal of a bit destroys the "C-spring" which is in place. Another type of driver uses a spring pin or rivet forced through a hole drilled into both the driver and tool bit.

Another problem encountered is that there may be many different types of tool bits which desirably are to be used with a driver. If the retaining means of a particular bit driver is customized, its use is likewise limited, resulting in a need for several kinds of drivers to accommodate the bits required for different tasks.

OBJECTS OF THE INVENTION

A primary object of this invention is to provide a new and improved bit driver particularly suited for quick and easy manual removal and replacement of a bit without requiring any tools whatsoever.

Another object of this invention is to provide a new and improved bit driver which optimizes the available driving faces of the driver while positively retaining the bit in a secure operating position within the driver.

A further object of this invention is to provide such a bit driver which may be used with a variety of different types of tool bits of a given shank size.

Other objects will be in part obvious and in part pointed out in more detail hereinafter.

SUMMARY OF THE INVENTION

A bit driver is provided with a body having a non-circular drive opening for mounting the bit driver on a drive tang, a non-circular bit socket for holding a bit, and an intermediate through-opening connecting the drive opening and the socket. Diametrically opposed bit socket grooves extend symmetrically along adjacent internal bit drive faces of the socket. A spring insertable in the drive opening into an operating position has resilient fingers which include offset shoulders diverging in relatively outwardly extending relation to one another and terminate in reversely bent ends defining inwardly directed bit-gripping faces in opposed confronting relation to one another. The spring has a base with a minimum dimension greater than the maximum cross-sectional dimension of the intermediate through-opening of the body which connects the fingers. In the operating position of the spring, the fingers extend through the intermediate opening and are biased into the grooves. The base is resiliently biased by the fingers into positive engagement with an annular internal shoulder formed within the body at the juncture of its through-opening and drive opening. The spring fingers are disposed within the socket adjacent an internal neck within the body defined by a juncture of the socket and intermediate through-opening. A bit of hexagonal cross-section configured and dimensioned to be received in a driving position within the socket has notches formed in longitudinal edges extending between adjacent external walls of the bit. In its operating position, the spring assumes a relaxed condition in the absence of a bit within the socket in which the bit-gripping faces are in interfering relation to insertion of a bit in the socket. A bit is manually inserted into the bit socket, which displaces the bit-gripping faces with a leading end of the bit, until the bit is in a driving position in the socket. In that driving position, the bit is bottomed in the socket against the offset shoulders of the spring; its fingers are in surface-to-surface engagement with the bit shank within its notches and are received in their entirety within the grooves.

BRIEF DESCRIPTION OF THE DRAWINGS

FIG. 4 is a top view showing a socket in the bit driver of this invention; and FIG. 5 is a bottom view showing a drive opening of the bit driver of this invention.

A better understanding of the objects, advantages, features, properties and relations of the invention will be obtained from the following detailed description and accompanying drawings which set forth an illustrative embodiment and is indicative of the way in which the principle of the invention is employed.

DETAILED DESCRIPTION OF THE INVENTION

Figure 1:
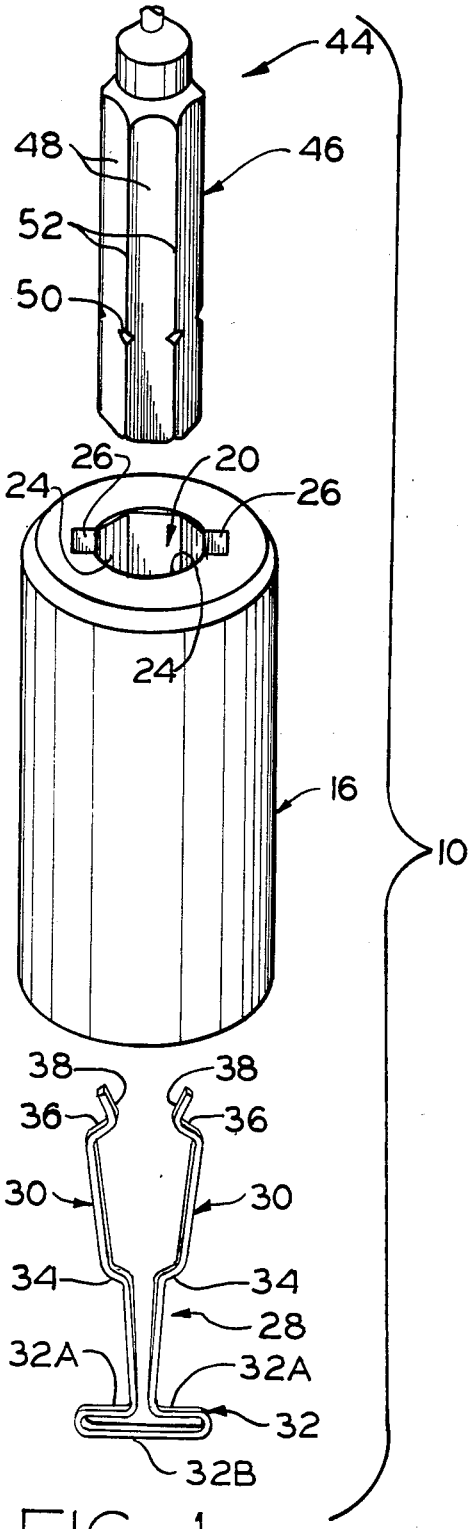
FIG. 1 is a perspective view of three components of a tool bit driver of this invention, showing the components in disassembled relation.
Figure 2:
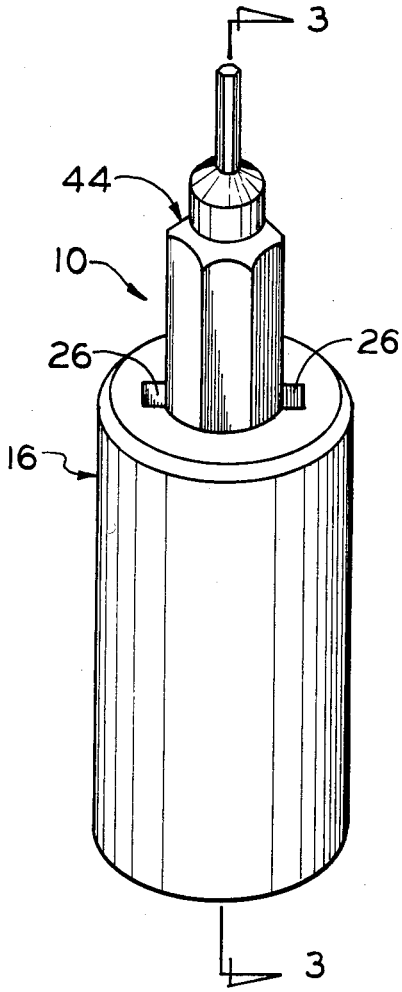
FIG. 2 is a perspective view of the bit driver of FIG. 1 showing its components in assembled relation.

A tool bit driver 10 of the present invention is illustrated with its components in disassembled and assembled relation in FIG. 1 and FIG. 2 respectively. Driver 10 is suitable for mounting on a socket wrench, not shown, having a square drive tank shown in broken lines at 12 in FIG. 3. Bit driver 10 features a construction which is particularly well suited for easy manual replacement of bit 14 in a single step without the risk of inadvertent displacement of the bit 14 from the driver 10 during use. As will be seen, driver 10 is also compatible with many different types of tool bits, thus reducing the number of drivers which must be made available for a variety of different tasks.

Figure 3:
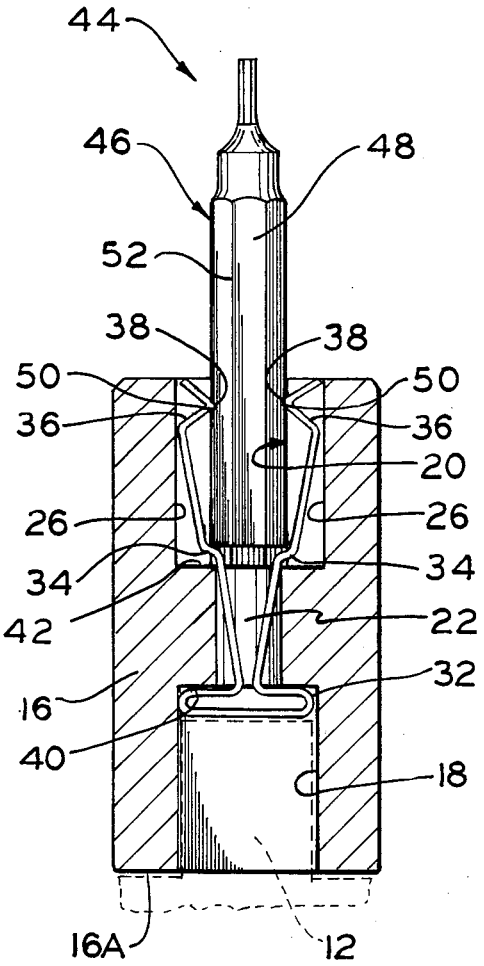
FIG. 3 is a side view, partly in cross section and partly broken away, taken generally along line 3—3 of FIG. 2.

Driver 10 has a body 16 which is tubular with a non-circular drive opening 18 (FIG. 3) at one end, a non-circular bit socket 20 (FIGS. 1 and 3) at the other end and an intermediate through-opening 22 (FIG. 3). Drive opening 18, socket 20 and intermediate through-opening 22 are axially aligned within the body 16. Drive opening 18 is illustrated as being of square cross-section (as best seen in FIG. 5) and has internal walls corresponding to the square driving member 12 of a socket wrench (not shown). Socket 20 is of hexagonal cross-section (as best seen in FIG. 4), and its internal walls define bit drive faces 24.

To provide a bit driver which is capable of securely retaining a bit in operating position requiring a minimum number of components to effect quick and easy bit replacement, spring retention grooves 26 are formed within the socket 20 in diametrically opposed relation to one another (as seen in FIGS. 1 and 4) and are formed to extend symmetrically along adjacent interal bit drive faces 24 of socket 20. Intermediate through-opening 22 connects drive opening 18 and socket 20 and is of smaller diameter than either the drive opening 18 or socket 20.

To positively secure a bit within socket 20 in a releasable locking arrangement, an articulated spring 28 (FIG. 1) is provided formed of a suitable resilient material and has a pair of retaining fingers 30 connected by a base 32. Base 32 has a pair of legs 32A which are connected to fingers 30 to extend in opposite directions and are reversely bent to be integrally joined by a connecting portion 32B. Its minimum dimension is greater than the maximum cross-sectional dimension of intermediate through-opening 22 (as best shown in FIG. 3). Spring fingers 30 diverge relative to one another from their respective legs 32A and have offset shoulders 34 extending relatively outwardly relative to one another. The spring fingers 30 terminate in reversely bent ends 36 defining inwardly directed bit-gripping faces 38 in opposed confronting relation to one another.

By virtue of the above described construction, the spring 28 is readily insertable into the driver body 16 to assume a stabilized operating position. In that operating position (FIG. 3), the fingers 30 extend through intermediate through-opening 22 and are biased by the spring material into grooves 26. Base 32 is resiliently biased by fingers 30 into positive bottoming engagement with an annular shoulder 40 formed within body 16 at a juncture of through-opening 22 and drive opening 18 for resisting unintended displacement of the base 32 of the spring 28 within the drive opening 18 in a direction from drive opening 18 toward socket 20. Offset shoulders 34 are disposed within socket 20 adjacent an internal neck 42 formed within body 16 at a juncture of socket 20 and intermediate through-opening 22 for resisting unintended displacement of the fingers 30 of the spring 28 in a direction from socket 20 toward drive opening 18.

Turning now to the bit 44, which is shown for illustrative purposes only, bit 44 has an elongated shank 46 of hexagonal cross-section which is configured and dimensioned to be received in a driving position shown in FIGS. 2 and 3 within bit socket 20. In that driving position, external walls (such as at 48) of the bit 44 are in driving engagement with internal drive faces 24 within socket 20, and the bit and driver cooperate to fix the bit in position.

More specifically, the spring fingers 30 are dimensioned and configured such that with the fingers in a flexed operating position within grooves 26 when a bit is received within socket 20 in its driving position, spring biasing forces are applied against the bit shank 46 for positively retaining bit 44 against unintended displacement from within socket 20. As shown in FIG. 3, bit-gripping faces 38 of the fingers 30 are in surface-to-surface engagement with shank 46 within notches 50 formed in longitudinal edges 52 extending between adjacent external walls 48 of the bit 44, the notches 50 being best seen in FIG. 1. Portions of the fingers 30 above shoulders 34 are received in their entirety within their respective grooves 26 in the flexed operating position of the spring 28 with the fingers 30 being seated in contact engagement against the body 16 defining the grooves 26. In that flexed operating position, bit 44 is bottomed within socket 20 against offset shoulders 34 of the spring fingers 30 in the driving position of the bit 44.

In the absence of a bit 44, spring 28 assumes a relaxed operating position (not shown) in which the bit-gripping faces 38 of the fingers 30 will be understood to be disposed inwardly of their retention grooves 26 in interfering relation to insertion of any bit into socket 20.

Positioning of spring 28 within body 16 is quickly and easily accomplished manually by squeezing the spring fingers 30 together, orienting them angularly with grooves 26, and pressing the spring 28 through the drive opening 18 with the fingers 30 extending through intermediate through-opening 22 and into socket 20 to snap into grooves 26 with the spring 28 assuming its relaxed operating position within body 16. In the absence of any bit within socket 20, spring 28 may be removed by compressing its fingers 30 so that their shoulders 34 are in non-interfering relation with the intermediate through-opening 22 and then pushing the spring 38 back through drive opening 18. Once spring 28 has been placed in its operating position in the body 16, driver 10 may be mounted on a socket wrench by aligning drive opening 18 with the driving member 12 of the socket wrench and advancing the driving member 12 into the drive opening 18 until the driving member 12 is fully seated against the bottom 16A of the body 16, thereby trapping spring base 32 in its operating position (FIG. 3).

To then insert a bit 44 into socket 20, bit 44 is axially aligned with the body 16 and the external faces 48 of bit 44 are aligned with internal driving faces 24 of socket 20. Bit shank 46 simply is pushed into socket 20 by hand, displacing reversely bent ends 36 from their relaxed condition into their flexed condition of the operating position. Advancement of bit 44 within socket 20 continues until the bit shank 46 bottoms aginst the offset shoulders 34 and the bit-gripping faces 38 of the spring fingers 30 seat within the notches 50 of the bit shank 46, at which point bit 44 will be in its driving position within socket 20 and spring 28 will be in its flexed condition of its operating position.

Bit 44 may be easily removed by hand for replacement with a variety of different bits of the same given shank size by manually drawing bit 44 from socket 20 and dislodging bit-gripping faces 38 from notches 50. Withdrawal of bit 44 from socket 20 removes bit shank 46 from between the bit-gripping faces 38, causing spring 28 to return into its relaxed operating position.

It will now be appreciated that a single bit driver constructed in accordance with this invention accomodates tool bits of different types with fastener driving elements of different sizes and shapes simply by being compatible with a standard given size hexagonal tool bit shank.

As will be apparent to persons skilled in the art, various modifications, adaptations and variations of the foregoing specific disclosure can be made without departing from the teaching of this invention.

I claim:

1. A tool bit driver comprising a body having a non-circular drive opening, a non-circular bit socket and an intermediate through-opening of reduced cross-section connecting the drive opening and socket; the drive opening, socket and connecting through-opening being in coaxially aligned relation within the body; the bit socket having internal walls defining bit drive faces with a pair of spring finger retention grooves formed therein; and a spring formed of resilient material and having a pair of bit retaining fingers and a base connecting those fingers; the base of the spring having a minimum dimension greater than the maximum cross-sectional dimension of the intermediate through-opening of the body; the spring being insertable into the drive opening into an operating position within the body wherein the base of the spring is positively secured against unintended displacement within the drive opening of the body and the fingers of the spring extend through the intermediate through-opening and are biased by the spring material into seating engagement within the grooves of the socket.

2. The driver of claim 1 wherein the spring finger retention grooves are formed within the socket in diametrically opposed relation to one another.

3. The driver of claim 1 wherein the spring fingers are dimensioned and configured to apply biasing forces against a bit shank inserted between the fingers for positively retaining the bit against unintended displacement within the socket.

4. The driver of claim 1 wherein an annular internal shoulder is formed within the body at a juncture of its through-opening and drive opening; and wherein the base of the spring is resiliently biased by the fingers into positive engagement with the annular internal shoulder within the body when the spring is in its operating position for resisting unintended displacement of the spring in a direction from the drive opening toward the socket.

5. The driver of claim 1 wherein an internal neck is defined within the body at a juncture of bit socket and intermediate through-opening; and wherein each of the spring fingers in the operating position of the spring are engaged with the internal neck within the body for resisting unintended displacement of the spring from its operating position within the body.

6. The driver of claim 5 wherein the spring fingers have offset shoulders diverging in relatively outwardly extending relation to one another; and wherein the offset shoulders are disposed within the socket adjacent said internal neck within the body for resisting unintended displacement of the spring in a direction from the socket toward the drive opening.

7. The driver of claim 1 wherein the spring fingers diverge relative to one antoher from the base of the spring and terminate in reversely bent ends defining inwardly directed bit-gripping faces in opposed confronting relation to one another.

8. The driver in claim 7 wherein the spring assumes a relaxed condition of its operating position in the absence of a bit within the socket; and wherein the spring in said relaxed condition has the bit-gripping faces of its fingers disposed inwardly of the retention grooves in the socket in interfering relation to insertion of a bit into the socket and for positively gripping and resiliently retaining a bit upon being moved by a bit outwardly into the grooves into a flexed condition of its operating position.

9. The driver of claim 1 wherein the socket is of hexagonal cross-section; and wherein the driver further includes an elongated bit having a shank of hexagonal cross-section configured and dimensioned to be received in a driving position within the socket with external walls of the bit in driving engagement with the internal drive faces within the socket.

10. The driver of claim 9 wherein the spring finger retention grooves of the socket are formed in diametrically opposed relation to one another within the socket; wherein the grooves each are formed to extend symmetrically along adjacent internal bit drive faces of the socket; and wherein the bit has longitudinal edges extending between adjacent external walls of the bit with notches formed in those edges for receiving the bit-gripping faces of the spring fingers in surface-to-surface engagement when the bit is in driving position within the socket.

11. The driver of claim 10 wherein the spring fingers have offset shoulders diverging in relatively outwardly extending relation to one another; wherein the offset shoulders in the operating position of the spring are disposed within the socket adjacent an internal neck within the body defined by a juncture of its socket and intermediate through-opening for resisting unintended displacement of the spring in a direction from the socket toward the drive opening; and wherein the bit in its driving position is bottomed within the socket against the offset shoulders of the spring fingers.

* * * * *